US012534983B2

(12) United States Patent
King

(10) Patent No.: US 12,534,983 B2
(45) Date of Patent: Jan. 27, 2026

(54) SYSTEMS AND METHODS FOR EXPANDING A LINER HANGER USING A SEGMENTED SWAGE ASSEMBLY

(71) Applicant: Innovex International, Inc., Houston, TX (US)

(72) Inventor: Kyle A. King, Cypress, TX (US)

(73) Assignee: Innovex International, Inc., Houston, TX (US)

( * ) Notice: Subject to any disclaimer, the term of this patent is extended or adjusted under 35 U.S.C. 154(b) by 2 days.

(21) Appl. No.: 18/658,778

(22) Filed: May 8, 2024

(65) Prior Publication Data

US 2025/0347201 A1 Nov. 13, 2025

(51) Int. Cl.
*E21B 43/10* (2006.01)

(52) U.S. Cl.
CPC ..... *E21B 43/105* (2013.01)

(58) Field of Classification Search
CPC ..... E21B 43/105
See application file for complete search history.

(56) References Cited

U.S. PATENT DOCUMENTS 180,169 A * 7/1876 Tasker ..... B23B 31/40 279/2.13
2004/0168796 A1* 9/2004 Baugh ..... E21B 43/105 166/207
2006/0207760 A1* 9/2006 Watson ..... E21B 43/105 166/207
2007/0277971 A1* 12/2007 Garcia ..... E21B 43/105 166/212
2011/0000664 A1* 1/2011 Adam ..... E21B 43/105 166/207
2013/0299197 A1* 11/2013 Bennett ..... E21B 43/105 166/207
2016/0032695 A1* 2/2016 Luke ..... E21B 34/066 166/382
2021/0102448 A1* 4/2021 Fraser ..... E21B 43/127

* cited by examiner

*Primary Examiner* — D. Andrews
(74) *Attorney, Agent, or Firm* — Baker Botts L.L.P.

(57) ABSTRACT

A system includes a liner hanger, a segmented swage assembly, and a running tool. The liner hanger is configured to set within a wellhead. The segmented swage assembly is configured to deploy the liner hanger into a casing within the wellhead. The segmented swage assembly comprises a first plurality of segments coupled to the running tool and a second plurality of segments coupled to the liner hanger. The first and second plurality of segments are configured to form a segmented cone. The segmented cone is constructed in an expansion process by pushing the first plurality of segments and the second plurality of segments towards each other prior to expanding the liner hanger. The segmented cone is deconstructed by pushing the first plurality of segments and the second plurality of segments away from each other prior to retrieval.

20 Claims, 8 Drawing Sheets

SYSTEMS AND METHODS FOR EXPANDING A LINER HANGER USING A SEGMENTED SWAGE ASSEMBLY

TECHNICAL FIELD

The present disclosure relates generally to assemblies used with downhole tubulars and, more particularly, to a segmented swage assembly used to deploy an expandable liner hanger into a casing with a large inner diameter.

BACKGROUND

The drilling, completion and servicing of oil and gas wells typically requires the use of strings of tubulars of various sizes in a wellbore in order to transport tools, provide a path for drilling and production fluids, and in some cases, to line the wellbore in order to isolate hydrocarbon bearing formations and provide support to the wellbore. Liners and casing strings are two types of tubulars that are both sections of pipe that are run into the wellbore and cemented in place to isolate and support the wellbore. Due to their different characteristics and applications, conventional wellhead systems usually use a combination of both to optimize the well performance and the project success based on: well type and geometry, formation characteristics, drilling challenges, well objectives, production requirements, and economic and environmental constraints. If the subterranean formation lacks structural integrity, it is typically lined with casing, which is inserted into the well and then cemented in place. As the well is drilled to a greater depth, smaller diameter strings of casing are lowered into the wellbore and attached to the bottom of the previous string of casing. The deeper the formation, the narrower the tubular members that are employed given the telescoping nature of how the strings are connected to one another.

For example, conventional wellhead systems include a wellhead housing and a subsurface casing string extending from the wellhead into the wellbore after drilling a borehole into a subterranean formation. During the drilling procedure, a drilling riser and a blowout preventer (BOP) are installed above the wellhead housing to provide pressure control as casing is installed, with each casing string having a casing hanger on its upper end for landing on a shoulder within the wellhead housing. Casing strings may provide a direct access to the surface for well control, testing, and completion operations to ensure control or quality of operations. Likewise, casing strings may reduce complexity and risk of failure or leakage, increase the rigidity and stability of the wellbore to prevent buckling, bending, or movement of the pipe, and offer more options for casing design and cementing program for better optimization of well objectives.

As another example, conventional wellhead systems include a liner which is hung from a previous casing string by a liner hanger which is a device that attaches the liner to the casing and seals the annulus between them. Liners have a shorter length compared to casing strings, and the liners do not extend to the surface. Liners are used to cut down on the amount of pipe and cement needed, thereby reducing material and operational costs. In particular, liners decrease the axial load and burst and collapse pressures on the previous casing string, which in turn enhances well integrity and safety. Additionally, liners allow for a larger hole size and a smaller casing size and provide flexibility for future well interventions, such as sidetracking, recompletion, or stimulation. As a result, liners may be used to improve drilling efficiency and well productivity.

It is necessary that a sufficient amount of space must exist in the space formed between the nested tubulars in order to facilitate the fixing, hanging and/or sealing of one tubular from another or the passage of cement or other fluid through the annulus. The hanging of downhole tubulars in this fashion starts at the wellhead and continues down the entire length of the wellbore. As wellbores get deeper and deeper, especially in offshore environments, the nesting of tubulars in this manner results in a narrowed production pipe. The narrower the production pipe, the smaller the amount of production that is capable of being drawn out of the well over a given period of time. It has therefore been desirable to expand downhole tubulars, including casing and production pipe in order to increase the flow area of the hydrocarbons being produced.

The desire to expand downhole tubulars extends not only to the nested tubing itself, but also to the various liner hangers upon which the nesting tubing hangs from the wellhead as well as the intermediate junctions along the wellbore. It is now recognized that a need exists for an alternative method to traverse wellhead inner diameter (ID) restrictions and deploy expandable liner hangers into casing with larger inner diameters.

SUMMARY

In accordance with the above, presently disclosed embodiments are directed to a method and system for using a segmented swage assembly to expand a liner hanger.

Among the many potential advantages to the methods, apparatus, and systems of the present disclosure, only some of which are alluded to herein, the present disclosure may provide a segmented swage assembly downhole to form a segmented cone to traverse wellhead inner diameter restrictions and deploy expandable liner hangers into casing with large inner diameters. The segmented cone may be constructed prior to expanding the liner hanger and deconstructed prior to retrieval. For example, in certain embodiments, the methods, apparatus, and systems of the present disclosure may provide a system which comprises a liner hanger configured to set within a wellhead, a segmented swage assembly configured to deploy the liner hanger into a casing within the wellhead. The segmented swage assembly comprises a first plurality of segments coupled to a running tool a second plurality of segments coupled to the liner hanger. The second plurality of segments may be configured to engage with the first plurality of segments to form a segmented cone. The segmented cone is constructed in an expansion process by pushing the first plurality of segments and the second plurality of segments towards each other prior to expanding the liner hanger. Likewise, the segmented cone is deconstructed by pushing the first plurality of segments and the second plurality of segments away from each other prior to retrieval.

For example, the first plurality of segments comprise three arc-shaped segments which are coupled to the running tool. As another example, the second plurality of segments comprise three arc-shaped segments which are coupled to the liner hanger. Thus, each of the first plurality of segments is configured to be in contact with and movable between two corresponding segments of the second plurality of segments. In particular, each of the first plurality of segments comprises a sliding track coupled to a slider of a respective segment of the second plurality of segments near their respective sides where they are in contact. In an embodiment, the segmented cone further comprises a main body, an inner diameter (ID), and an outer diameter (OD). For example, the segmented cone has an OD of 18.125 inches prior to expanding the liner hanger. As another example, the segmented cone has an OD of 19 inches when the expansion process is complete. Each of the second plurality of segments further comprises a detent on its downhole surface, the detent configured to engage with the liner hanger to ensure an expansion of the liner hanger is initiated when a predetermined load limit is exceeded. Each of the second plurality of segments further comprises a high velocity oxy-fuel (HVOF) pad on its surface, the HVOF pad configured to receive a direct overpull when the segmented swage assembly comes into contact with under-expanded portions of the liner hanger.

In an embodiment, a method may comprise positioning a segmented swage assembly into a wellhead using a running tool, applying an expansion stroke to the segmented swage assembly to expand the liner hanger until the segmented swage assembly bottoms out, and retaining the liner hanger in the wellhead via the segmented swage assembly. The segmented swage assembly is configured to deploy the liner hanger into casing within the wellhead. The segmented swage assembly may comprise a first plurality of segments coupled to a running tool and a second plurality of segments coupled to the liner hanger. The second plurality of segments may be configured to engage with the first plurality of segments to form a segmented cone. The segmented cone is constructed in an expansion process by pushing the first plurality of segments and the second plurality of segments towards each other prior to expanding the liner hanger. The segmented cone is deconstructed by pushing the first plurality of segments and the second plurality of segments away from each other prior to retrieval. For example, the first plurality of segments comprise three arc-shaped segments which are coupled to the running tool. As another example, the second plurality of segments comprise three arc-shaped segments which are coupled to the liner hanger. Thus, each of the first plurality of segments is configured to be in contact with and movable between two corresponding segments of the second plurality of segments. In particular, each of the first plurality of segments comprises a sliding track coupled to a slider of a respective segment of the second plurality of segments near their respective sides where they are in contact. The segmented cone further comprises a main body, an inner diameter (ID), and an outer diameter (OD). The segmented cone has an OD of 18.125 inches prior to expanding the liner hanger.

In an embodiment, the method may further comprise slacking off to release the liner hanger by putting the running tool away from the segmented swage assembly, pulling tension into the segmented swage assembly through direct overpull once an uphole edge of the segmented swage assembly comes into contact with under-expanded portions of the liner hanger, and deconstructing the segmented swage assembly and pull it out of hole. The method may further comprise expanding the segmented cone to fully form to reach a predetermined expansion OD of 19 inches when the expansion process is complete. Each of the second plurality of segments further comprises a detent on its downhole surface, the detent configured to engage with the liner hanger to ensure an expansion of the liner hanger is initiated when a predetermined load limit is exceeded. Each of the second plurality of segments further comprises a high velocity oxy-fuel (HVOF) pad on its surface, the HVOF pad configured to receive a direct overpull when the segmented swage assembly comes into contact with under-expanded portions of the liner hanger.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system-related and business-related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Certain embodiments of the present disclosure may be directed to systems and methods for expanding a liner hanger using a segmented swage assembly.

A segmented swage assembly may be used in an expandable liner hanger setting method. The segmented swage assembly may be coupled to an identical pressure activated, multi-piston hydraulic setting tool to traverse wellhead ID restrictions and deploy expandable liner hangers into a casing with a large inner diameter. In particular, the segmented swage assembly may be constructed prior to expanding the liner hanger and deconstructed prior to retrieval. Conventional expandable liner hanger setting methods may have some concerns: 1) run in hole (RIH) of consumable components is less than a required system drift, 2) expansion forces are close to an expander buckling limit, 3) potential to leave non-drillable components downhole, 4) limited drift clearance in American Petroleum Institute (API) ranged host casing, and 5) limited slip and seal footprint against the host casing. The segmented swage assembly may comprise RIH ID of consumable components which may allow a 16.5 inches bit to pass through the hanger. Also, the single expandable component has a wall with a thickness greater than 1 inch and increases hanger/casing contact area by 50%. Thus, the single expandable component may efficiently reduce required setting forces. The segmented swage assembly may reduce the risk of leaving an expander cone below a partially stuck expander. Furthermore, the segmented swage assembly may require less rental equipment and reduce cost of consumables.

Figure 1:
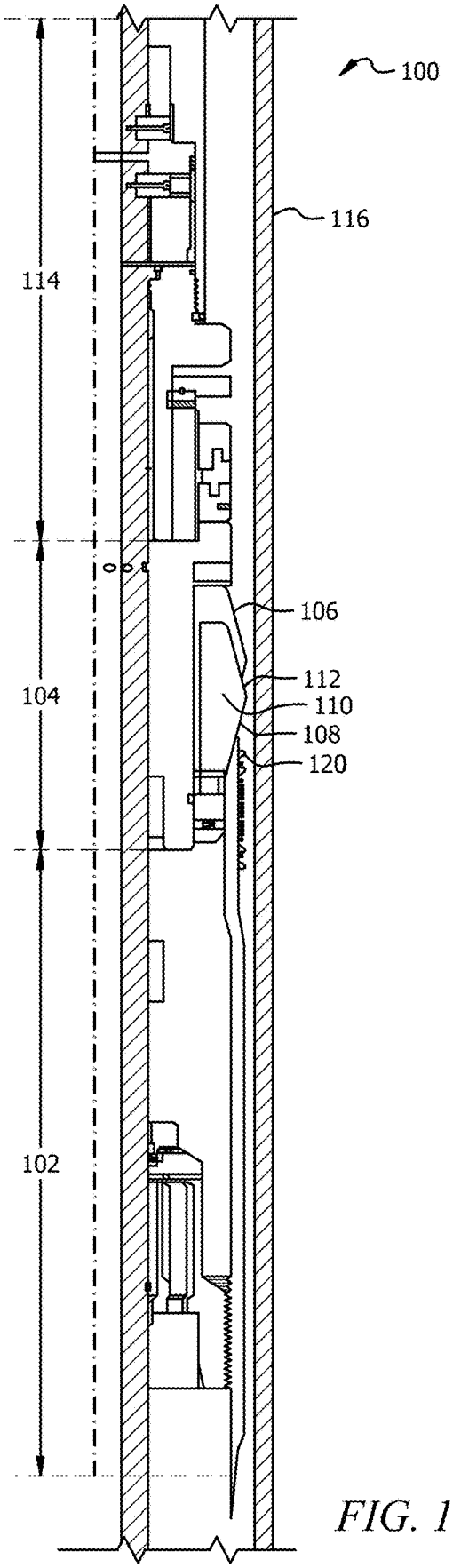
FIG. 1 illustrates a front view of a wellhead system with a segmented swage assembly, according to one or more embodiments of the present disclosure.

FIG. 1 illustrates a front view of a wellhead system 100 with a segmented swage assembly, according to one or more embodiments of the present disclosure. A segmented swage assembly 104 may be formed of one or more drillable materials, such as aluminum, copper alloys, mild steel, or any combination thereof. For example, the segmented swage assembly 104 may be used to expand an expandable liner hanger 102 which is secured to a casing hanger to be set in a wellhead. As another example, the segmented swage assembly 104 may be configured to deploy the expandable liner hanger 102 into a casing 116 within the wellhead. In particular, the segmented swage assembly 104 may be used to expand the inner diameter of the expandable liner hanger 102. The expandable liner hanger 102 may comprise a body in a cylindrical shape which has an inner diameter less than the outer diameter of the segmented swage assembly 104, wherein the inner diameter of the expandable liner hanger 102 may be 16.60 inches and the outer diameter of the segmented swage assembly 104 may be 18.125 inches. Liner hangers are generally used to hang strings of downhole tubulars. In a typical oil and gas well, there may be a series of liner hangers disposed along the length of the wellbore. Each series of tubing strings may have a progressively narrower diameter pipe. Tubular expanders, such as segmented swage assembly 104, may be used to expand the pipe, such as the expandable liner hanger 102, so that the tubulars have an increased inner diameter along the length of the well. As a result, the segmented swage assembly 104 may be coupled to an identical pressure activated, multi-piston hydraulic setting tool to create a mono-diameter pipe for casing or production along the length of the wellbore.

In some embodiments, the segmented swage assembly 104 may include a first plurality of segments, such as uphole segments 106, which are configured to couple with a second plurality of segments, such as downhole segments 108, to form a segmented cone 110 when the first plurality of segments and the second plurality of segments are fully expanded. An expansion process may be performed by using a running tool to convey the expandable liner hanger 102 and attached liner into the wellbore. The running tool may be interconnected between a work string and the expandable liner hanger 102. For example, the running tool may include a hydraulic setting tool 114 which contains a plurality of hydraulic control devices, such as a rupture disc and a check valve, to control the pressure within a polished bore receptacle (PBR) fluid chamber by regulating the ingress and exit of annular fluid from the fluid chamber. The first plurality of segments may be configured to couple to a hydraulic setting tool of the running tool. The second plurality of segments may be configured to couple to the expandable liner hanger 102. As another example, the work string may be a tubular string made up of drill pipe or other segmented or continuous tubular elements. The work string may be used to convey the running tool, the expandable liner hanger 102 and the attached liner into the wellbore, conduct fluid pressure and flow, transmit torque, tensile and compressive force, etc. As a result, the running tool may be used to facilitate conveyance and installation of the expandable liner hanger 102 and the attached liner using a force delivered by the work string, such as torque, tensile and compressive forces, fluid pressure and flow, etc.

In some embodiments, the segmented cone 110 may be configured to utilize a detent 204 (referring to FIG. 2A) on its downhole surface configured to engage with the expandable liner hanger 102 to initiate hanger expansion when a predetermined load limit, such as a target compressive load, is exceeded. The detent 204 may be a circular feature surrounding the segmented cone 110 near a bottom end. In particular, the detent 204 may provide a mechanism to prevent motion of the hanger expansion until the detent 204 is released. For example, the segmented cone 110 may be constructed in an expansion process by pushing the first plurality of segments and the second plurality of segments towards each other prior to expanding the expandable liner hanger 102. The segmented cone 110 may include a main body (referring to FIG. 2C), an inner diameter (ID) 210 (referring to FIG. 2D), and an outer diameter (OD) 212 (referring to FIG. 2C). Thus, the target compressive load may ensure the segmented swage assembly 104 may fully form to reach a predetermined expansion outer diameter (OD) prior to setting the expandable liner hanger 102. Thus, it is possible to achieve expandable liner hanger 102 as-installed geometry that exceeds wellhead restrictions in place. For example, the first plurality of segments of the segmented swage assembly 104 may include three arc-shaped segments which have a RIH OD of 18.125 inches. Likewise, the second plurality of segments of the segmented swage assembly 104 may include another three arc-shaped segments which have a RIH OD of 18.125 inches. Each of the first plurality of segments may be positioned between two corresponding segments of the second plurality of segments. In another example, the first plurality of segments and the second plurality of segments may include two arc-shaped segments each configured to translate relative to each other. In particular, the first plurality of segments may move in a downhole direction with respect to the second plurality of segments until to form the segmented cone 110. The segmented cone 110 may be held in place along with the main body of segmented swage assembly 104 by the running tool.

In some embodiments, the running tool may be configured to be released from the expandable liner hanger 102 after the hanger expansion is complete. The segmented cone 110 may be deconstructed by pushing the first plurality of segments and the second plurality of segments away from each other prior to retrieval. Each of the second plurality of segments may include an HVOF pad on its surface. The HVOF pad may be configured to receive a direct overpull when the segmented swage assembly 104 comes into contact with under-expanded portions near an uppermost and unsupported edge of the expandable liner hanger 102. In particular, the segmented swage assembly 104 may be deconstructed using a latching mechanism 120 through direct overpull once an uphole edge 112 of the segmented swage assembly 104 comes into contact with under-expanded portions of the expandable liner hanger 102. The latching mechanism 120 may include the uppermost, unsupported edge of the expanded hanger section. As another example, the segmented swage assembly 104 may apply the latching mechanism 120, which is set to release at an elevated target tensile limit, in order to pull the swage back through the expandable liner hanger 102. Thus, the latching mechanism 120 may provide an increase in hanger contact force with the casing 116. The segmented swage assembly 104 may deconstruct to traverse wellhead ID restrictions and deploy expandable liner hangers into casing 116 with large inner diameters. As a result, the segmented swage assembly 104 may provide several advantages: 1) increased hanger/casing contact area when using identical hydraulic setting tools, 2) reduced risk of leaving non-millable components below partially expanded liner components, and 3) decreased required setting forces required to fully set the expandable liner hanger which may in turn decrease the risk of buckling the tieback expander and hanger.

Figure 2A:
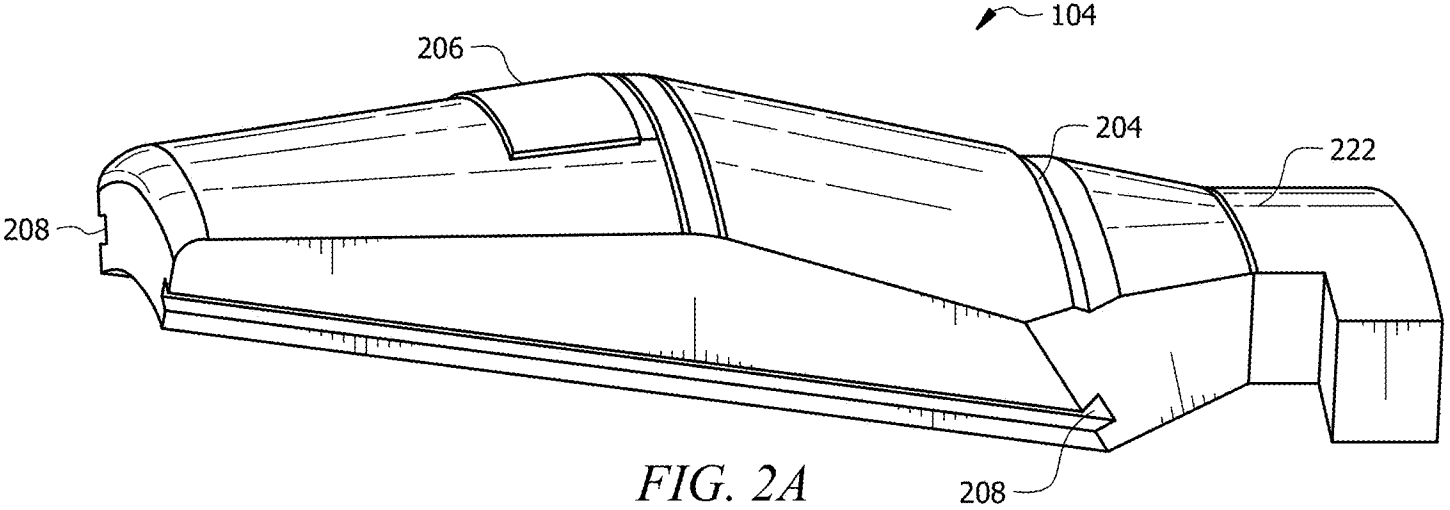
FIGS. 2A, 2B, 2C, and 2D illustrate perspective views of the segmented swage assembly, according to one or more embodiments of the present disclosure.

FIGS. 2A, 2B, 2C, and 2D illustrate perspective views of the segmented swage assembly, according to one or more embodiments of the present disclosure. FIG. 2A illustrates a perspective view of a single segment 222 of the segmented swage assembly 104, according to one or more embodiments of the present disclosure. The segment 222 may be any suitable size, height, shape, and/or combination thereof. In embodiments, the segment 222 may be arc-shaped. The single segment 222 may be a downhole segment 108 (referring to FIG. 1) which includes the detent 204 and a high velocity oxy-fuel (JVOF) pad 206. The detent 204 may engage with an expandable liner hanger 102 (referring to FIG. 1) to increase force required to initiate an expansion process. In particular, the detent 204 may be a circular feature surrounding the segmented cone 110 (referring to FIG. 1) near the bottom. The detent 204 may provide a mechanism to prevent motion of the hanger expansion until the detent 204 is released. A running tool may pull tension in the HVOF pad 206 to deconstruct the segmented swage assembly 104. The HVOF pad 206 may include a rectangular pad with an HVOF thermal sprayed coating on the surface of the downhole segment 222 to improve the surface of the segment in order to properly operate in harsh environments needing sliding, fretting, abrasion and erosion resistance, etc. The downhole segment 222 may be configured to be connected to a respective uphole segments 106 (referring to FIG. 1) using one or more sliding tracks 208 in a predetermined shape, such as a rectangular shape, near their respective sides where they are in contact. Likewise, an adjacent uphole segment, such as an uphole segment 232 (referring to FIG. 2B, may include a protrusion, such as slider 242 (referring to FIG. 2D), that fits into a corresponding sliding track 208 of the downhole segment 222. Thus, the downhole segment 222 may move between the uphole segment 232 to construct or destruct the segmented cone 110 (referring to FIG. 1).

Figure 2B:
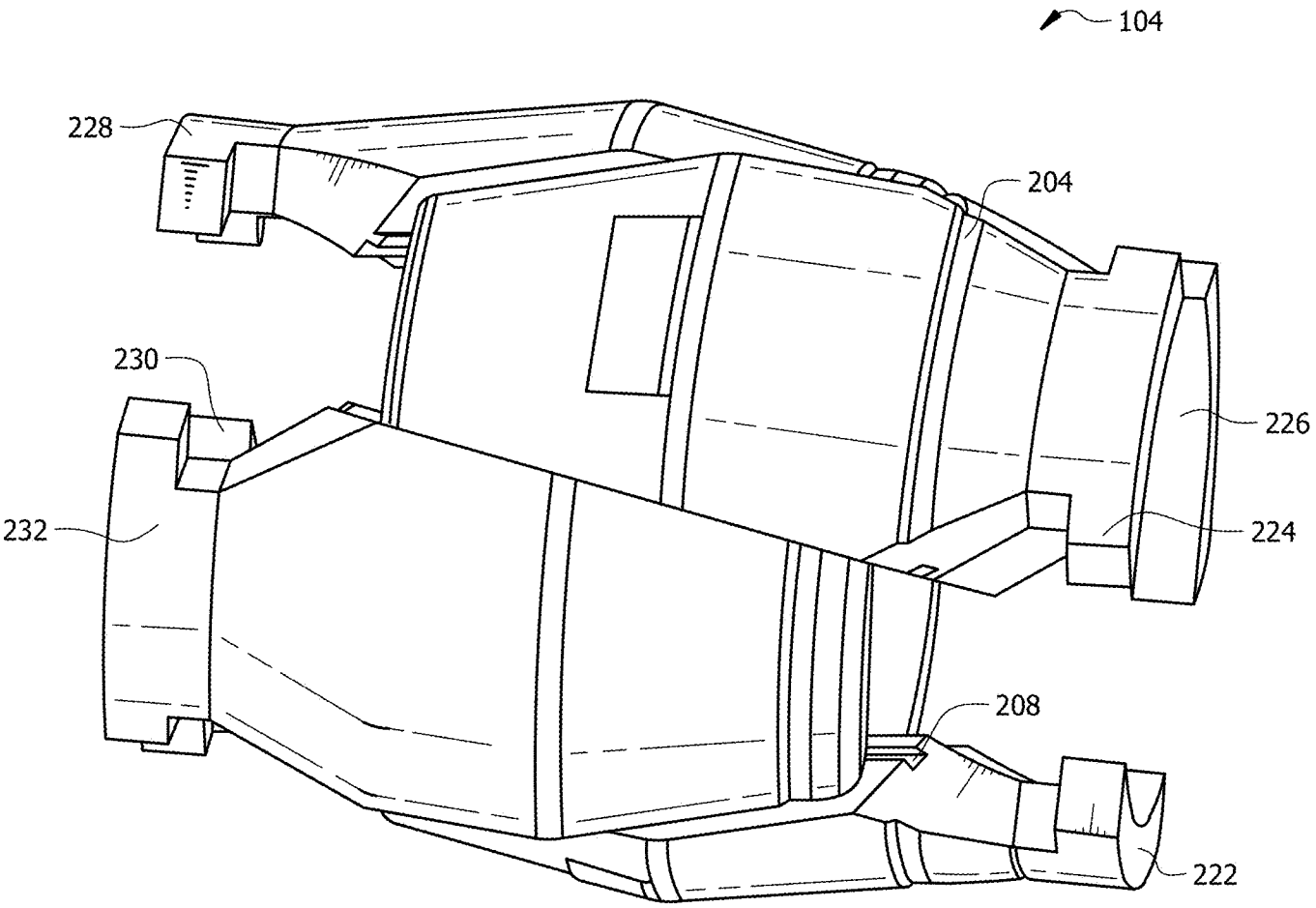

FIG. 2B illustrates a perspective view of the segmented swage assembly prior to expanding a liner hanger, according to one or more embodiments of the present disclosure. The segmented swage assembly 104 may include a first plurality of segments, such as uphole segment 228, uphole segment 230, and uphole segment 232, and a second plurality of segments, such as downhole segment 222, downhole segment 224, and downhole segment 226. The first plurality of segments may be configured to couple with the second plurality of segments using the sliding tracks 208 to form a segmented cone. For example, a downhole segment 222 may be coupled between its adjacent uphole segments, such as an uphole segment 230 and an uphole segment 232. In particular, the downhole segment 222 may include a slide track 208 at one edge to couple to a slider 242 (referring to FIG. 2D), such as a protrusion that fits into the slide track 208, at a respective edge of the uphole segment 232 to keep the downhole segment 222 and the uphole segment 232 in contact. Thus, each of the first plurality of segments may be configured to be in contact with and movable between two corresponding segments of the second plurality of segments. For example, uphole segment 228 may be in contact with downhole segment 224 and downhole segment 226. As another example, uphole segment 230 may be in contact with downhole segment 222 and downhole segment 226. As another example, uphole segment 232 may be in contact with downhole segment 222 and downhole segment 224. Prior to expanding a liner hanger, the segmented cone 110 may have an 18.125 inches RIH OD. The segmented cone 110 may utilize the detent 204 on its downhole surface or some other means to ensure hanger expansion does not commence until a desired load limit is exceeded. This target compressive load may ensure the segmented swage assembly 104 fully forms to reach a predetermined expansion OD, such as a 19 inches OD, prior to setting the expandable liner hanger 102.

Figure 2C:
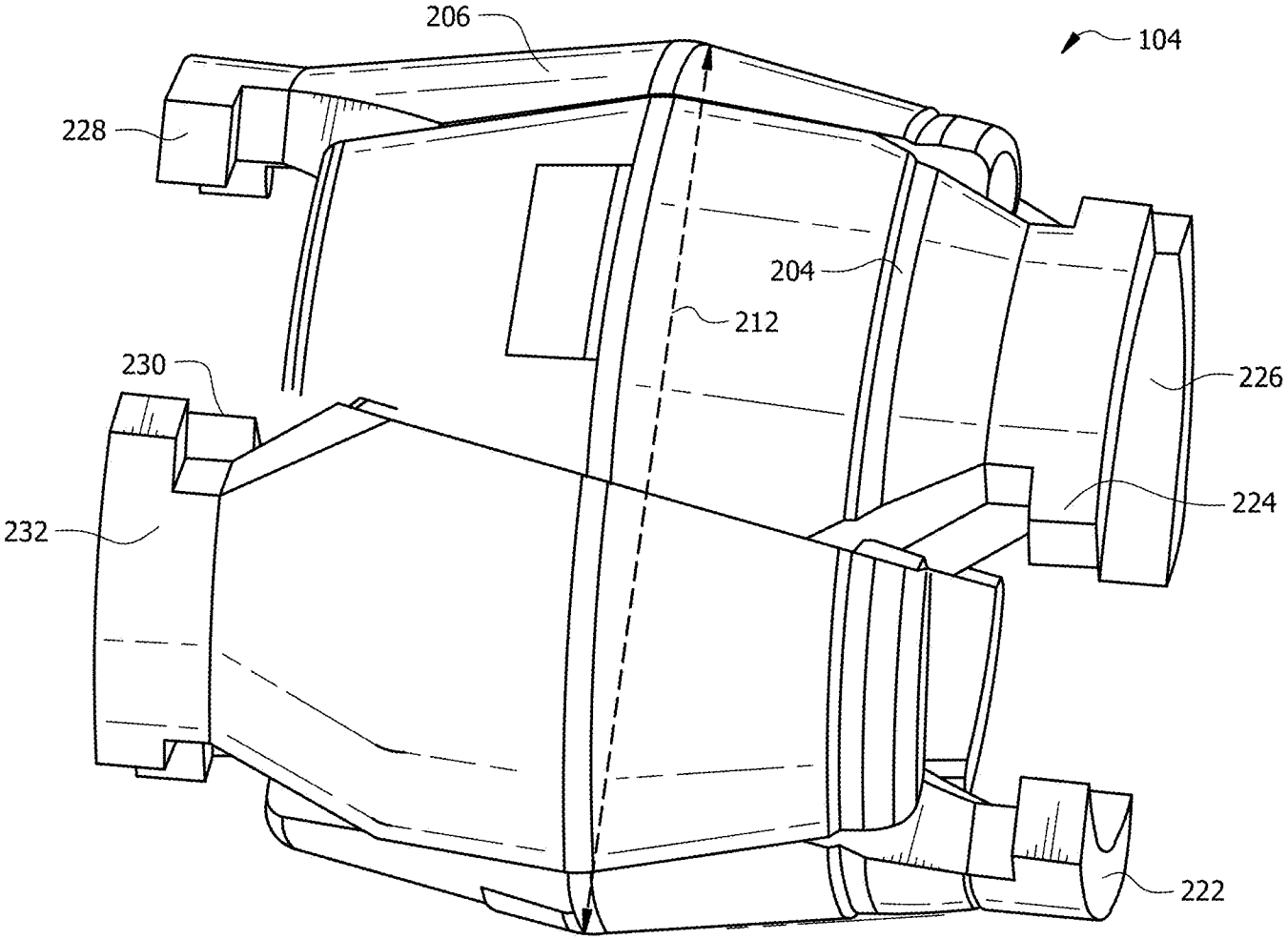
Figure 2D:
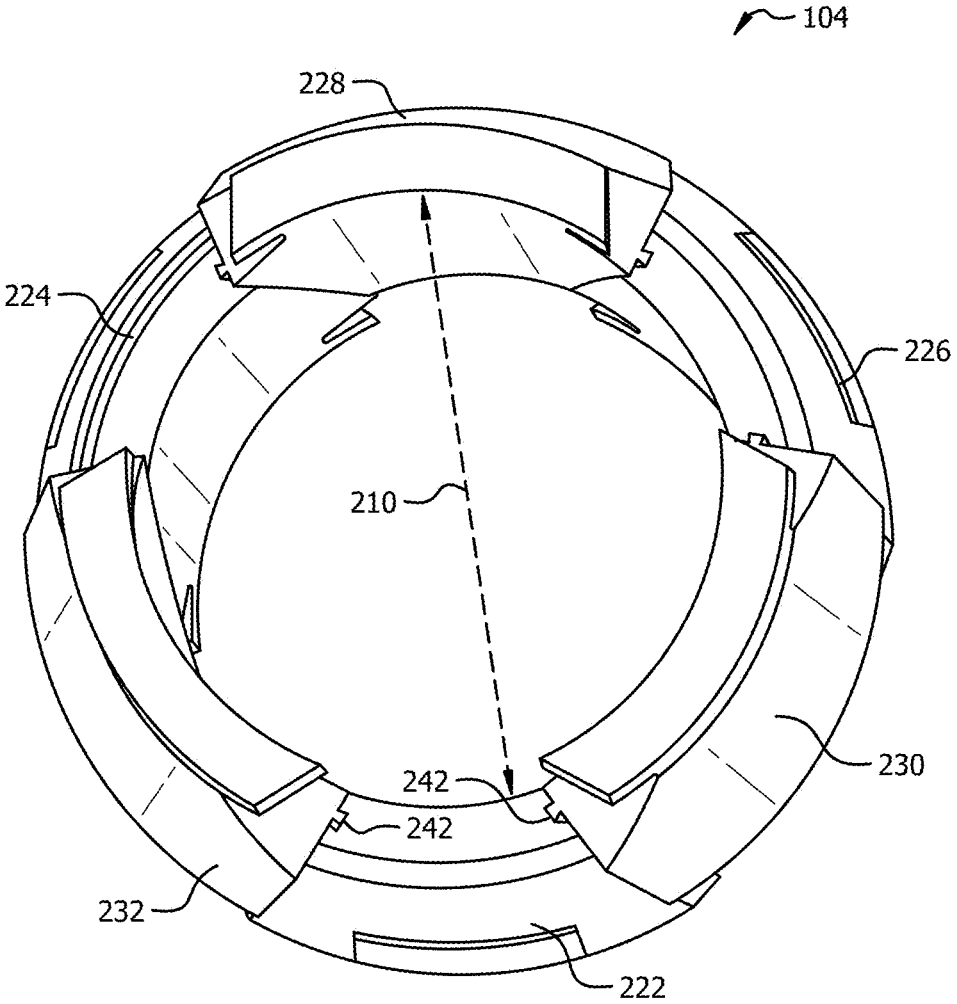

FIGS. 2C and 2D illustrate perspective views of the segmented swage assembly when a process of expansion is complete, according to one or more embodiments of the present disclosure. Downhole detent 204 may engage with the expandable liner hanger 102 (referring to FIG. 1) to increase force required to initiate expansion. When the expansion process is initiated, a first expansion stroke of 2.5 inches is applied to fully form the segmented cone 110 (referring to FIG. 1) to reach the predetermined expansion OD, such as a 19 inches OD.

Figure 3A:
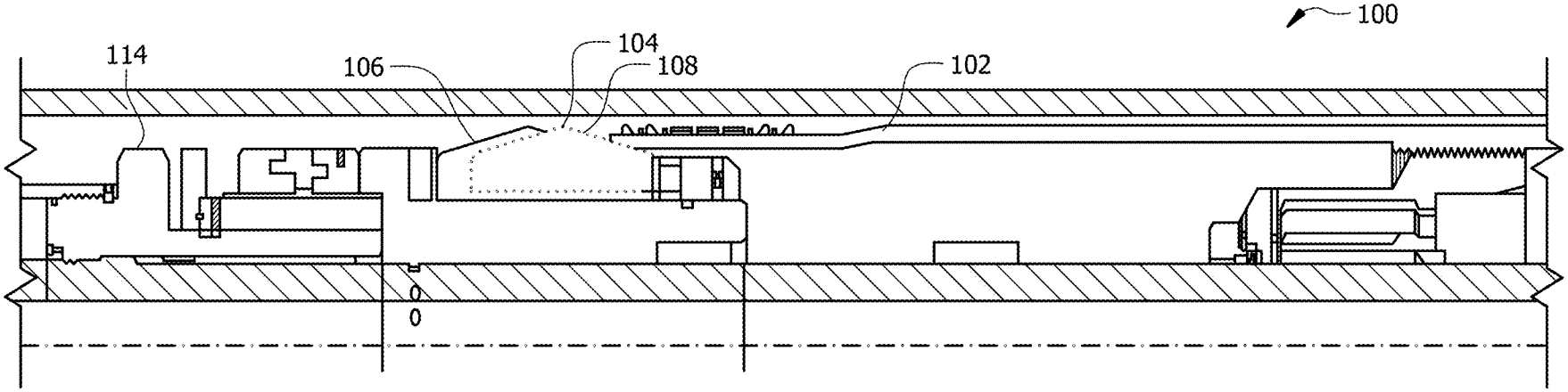
FIGS. 3A, 3B, 3C, 3D, 3E, and 3F illustrate a sequence of expanding a liner hanger and deconstructing a segmented swage assembly, according to one or more embodiments of the present disclosure.

FIGS. 3A, 3B, 3C, 3D, 3E, and 3F illustrate a sequence of expanding a liner hanger and deconstructing a segmented swage assembly, according to one or more embodiments of the present disclosure. FIG. 3A shows a first sequence step of placing a segmented swage assembly 104 in a run in hole position prior to expanding the expandable liner hanger 102. The expandable liner hanger 102 and the hydraulic setting tool 114 are run into the wellbore on a landing string (not shown) to a desired setting depth. The segmented swage assembly 104 may include uphole segments 106 and downhole segments 108. The expandable liner hanger 102 may have a 16.60 inches ID and a wall of a 0.7 inch thickness. The segmented swage assembly 104 may have an 18.125 inches effect RIH OD.

Figure 3B:
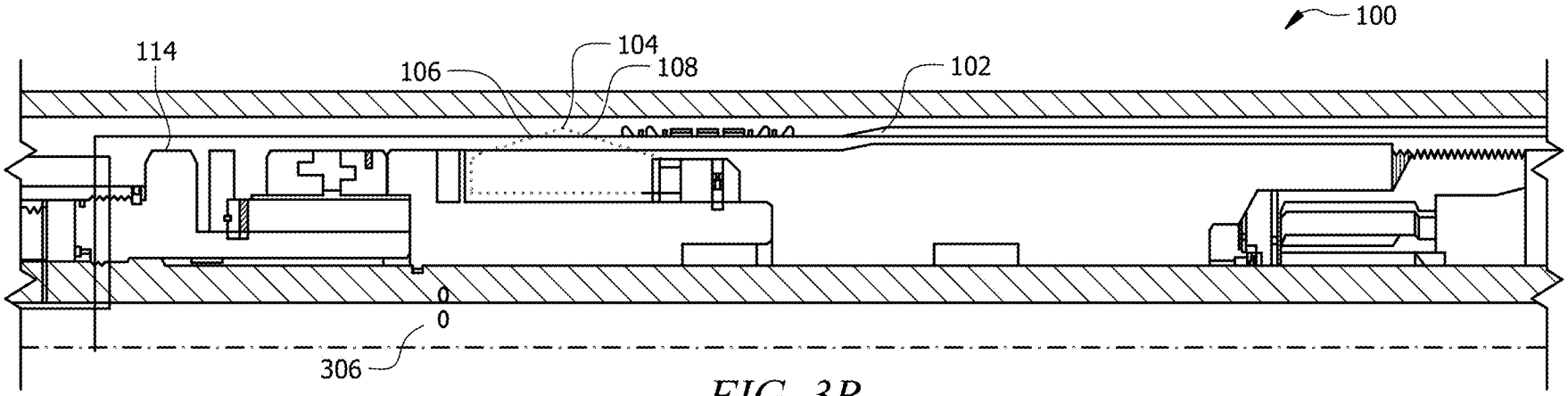

FIG. 3B shows a second sequence step of applying a first expansion stroke of 2.5 inches to the segmented swage assembly 104 to form expansion swage. In particular, the downhole segments 108 include a detent on its downhole surface to engage with the expandable liner hanger 102 to increase force required to initiate expansion. The hanger expansion process starts when the force exceeds a target compressive load. For example, a shear force of 49,200 pounds between an inner tubular 306 and the segmented swage assembly 104 is needed to initiate expansion. The hydraulic setting tool 114 may exert an inward compressive force on the segmented swage assembly 104 to push the uphole segments 106 and the downhole segments 108 to move towards each other. Thus, a segmented cone 110 is formed by gradually locking the uphole segments 106 and the downhole segments 108 of the segmented swage assembly 104. As a result, the fully formed segmented cone may have a 19 inches OD.

Figure 3C:
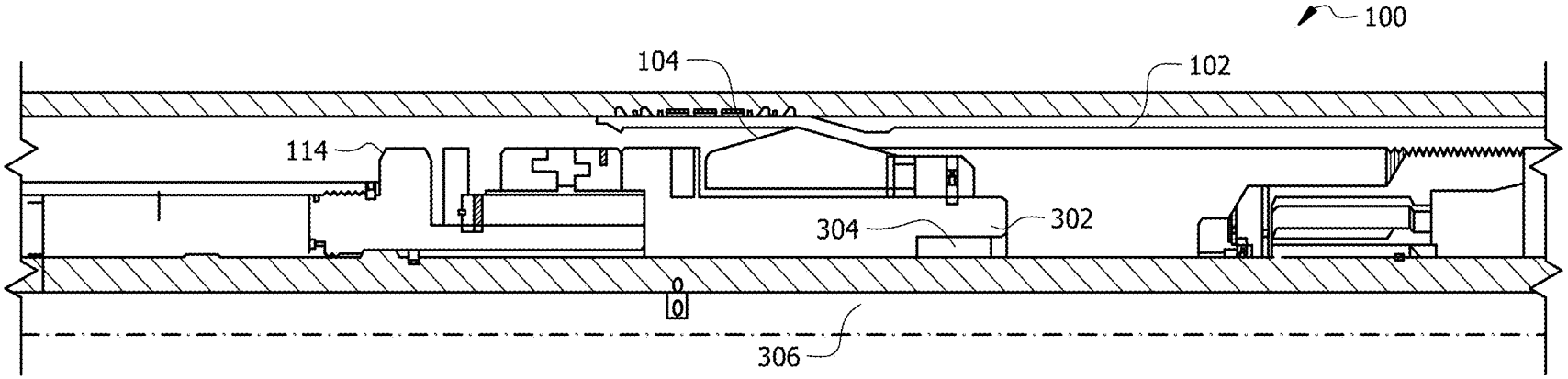

FIG. 3C shows a third sequence step of continuing expansion until the segmented swage assembly 104 bottoms out. The hydraulic setting tool 114 and the segmented swage assembly 104 may move in a downhole direction to expand the expandable liner hanger 102 until a travel stop 302 reaches a shoulder 304 protruding from the inner tubular 306, wherein the hydraulic setting tool 114 and the segmented swage assembly 104 may have reached the end of their stroke. As a result, the hydraulic setting tool 114 may retain the expandable liner hanger 102 in the wellhead via the segmented swage assembly 104.

Figure 3D:
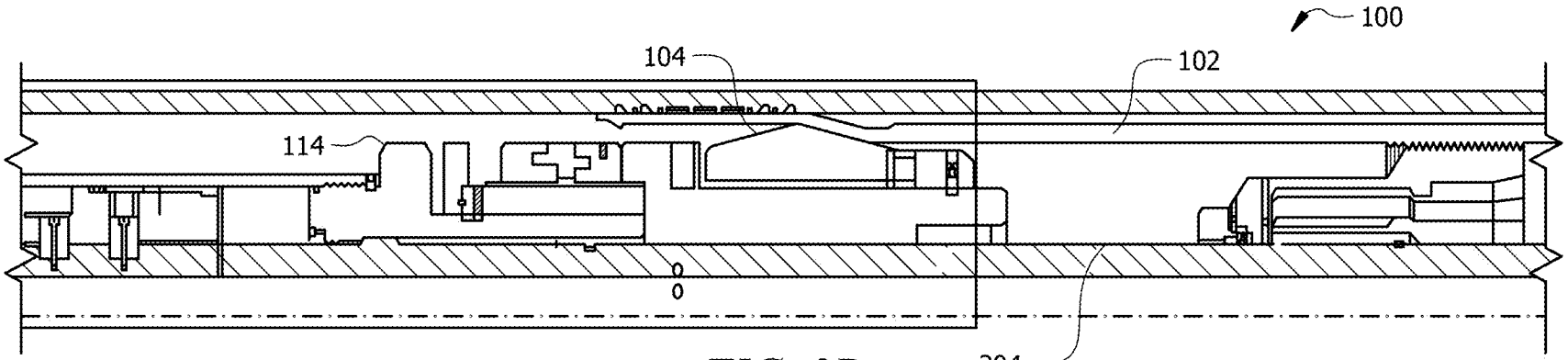

FIG. 3D shows a fourth sequence step of slacking off to release the expandable liner hanger 102 by disposing the running tool, such as the hydraulic setting tool 114, away from the segmented swage assembly 104. The segmented swage assembly 104 may use a latching mechanism which is set to release at an elevated target tensile limit in order to pull the segmented swage assembly 104 back through the expandable liner hanger 102. This would provide an increase in hanger contact force with the casing. The segmented swage assembly 104 may then move away from the casing connections, such as shoulder 304, and deconstruct against a downhole edge of the wellhead housing restriction.

Figure 3E:
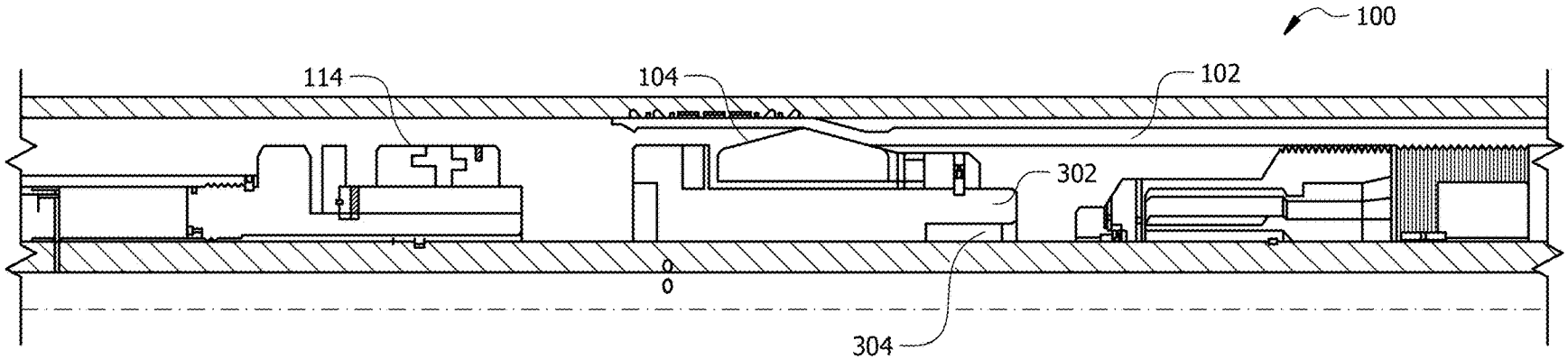
Figure 3F:
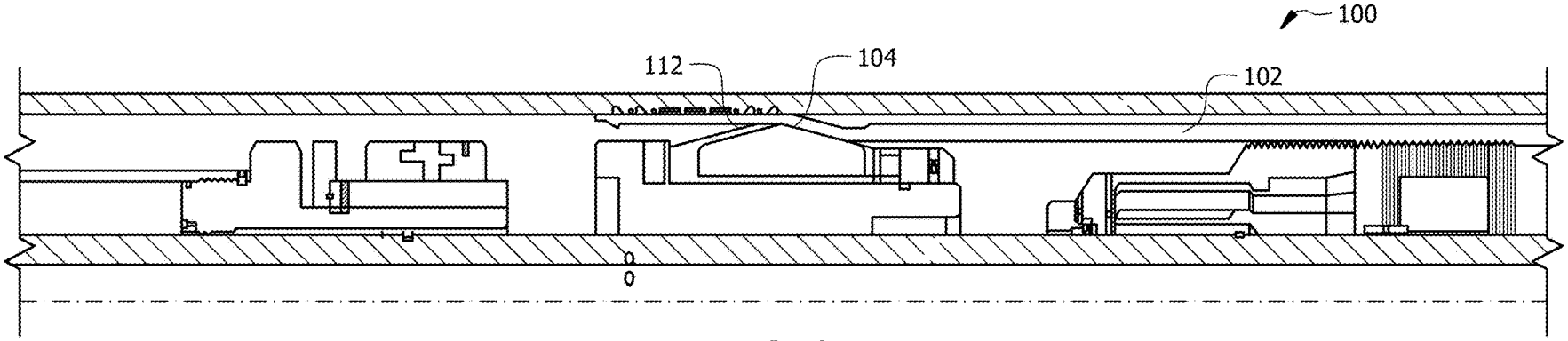

FIG. 3E shows a fifth sequence step of picking up to release the hydraulic setting tool 114 and pull tension into the segmented swage assembly 104. In particular, the segmented swage assembly 104 may be deconstructed through direct overpull once an uphole edge of the segmented swage assembly 104 comes into contact with under-expanded portions of the liner hanger 102. Thus, the hydraulic setting tool 114 may detach from the segmented swage assembly 104 by moving in an uphole direction. Likewise, the segmented swage assembly 104 may pick up the expandable liner hanger 102 until the travel stop 302 reaches the shoulder 304, FIG. 3F shows a sixth sequence step of deconstructing the segmented swage assembly 104 and pull it out of hole. Pulling tension into any obstruction may shear retaining pins, and deconstruct the segmented swage assembly 104. The segmented swage assembly 104 may be deconstructed through direct overpull once the uphole edge 112 of the segmented swage assembly 104 comes into contact with under-expanded portions of the expandable liner hanger 102. This point may be the uppermost, unsupported edge of the expandable liner hanger 102.

Although the present disclosure and its advantages have been described in detail, it should be understood that various changes, substitutions and alterations can be made herein without departing from the spirit and scope of the disclosure as defined by the following claims.

What is claimed is:

1. A system, comprising:

a liner hanger configured to set within a wellhead;

a segmented swage assembly configured to deploy the liner hanger into a casing within the wellhead, the segmented swage assembly comprising:

a first plurality of segments coupled to a running tool; and a second plurality of segments coupled to the liner hanger, wherein the second plurality of segments are configured to engage with the first plurality of segments to form a segmented cone, the segmented cone adapted to expand by pushing the first plurality of segments and the second plurality of segments towards each other prior to expanding the liner hanger, wherein each of the second plurality of segments further comprises a detent formed on its downhole surface, wherein the detent is a groove defined on the downhole surface that forms a circular feature surrounding the segmented cone when the segmented cone is formed.

2. The system of claim 1, wherein the segmented cone further comprises an inner diameter (ID) and an outer diameter (OD).

3. The system of claim 2, wherein the segmented cone has an OD of 18.125 inches prior to expanding the liner hanger.

4. The system of claim 2, wherein the segmented cone has an OD of 19 inches when an expansion process is complete.

5. The system of claim 1, wherein each detent is configured to engage with the liner hanger to ensure an expansion of the liner hanger is initiated when a predetermined load limit is exceeded.

6. The system of claim 1, wherein each of the second plurality of segments further comprises a high velocity oxy-fuel (HVOF) pad disposed on its surface, the HVOF pad configured to receive a direct overpull when the segmented swage assembly comes into contact with under-expanded portions of the liner hanger.

7. The system of claim 1, wherein the first plurality of segments comprises three arc-shaped segments which are coupled to the running tool.

8. The system of claim 1, wherein the second plurality of segments comprises three arc-shaped segments which are coupled to the liner hanger.

9. The system of claim 1, wherein each of the first plurality of segments is configured to be in contact with and movable between two corresponding segments of the second plurality of segments.

10. The system of claim 9, wherein:

each of the first plurality of segments comprises a sliding track engaged with a slider of a respective segment of the second plurality of segments near their respective sides where they are in contact.

11. A method, comprising:

positioning a segmented swage assembly into a wellhead using a running tool, the segmented swage assembly configured to deploy a liner hanger into a casing within the wellhead, the segmented swage assembly comprising:

a first plurality of segments coupled to the running tool; and a second plurality of segments coupled to the liner hanger, wherein the second plurality of segments are configured to engage with the first plurality of segments to form a segmented cone, the segmented cone adapted to expand by pushing the first plurality of segments and the second plurality of segments towards each other prior to expanding the liner hanger, wherein each of the second plurality of segments further comprises a detent formed on its downhole surface, wherein the detent is a groove defined on the downhole surface that forms a circular feature surrounding the segmented cone when the segmented cone is formed;

applying an expansion stroke to the segmented swage assembly to expand the liner hanger until the segmented swage assembly bottoms out; and retaining the liner hanger in the wellhead via the segmented swage assembly.

12. The method of claim 11, further comprising:

slacking off to release the liner hanger by disposing the running tool away from the segmented swage assembly; and pulling tension into the segmented swage assembly through direct overpull once an uphole edge of the segmented swage assembly comes into contact with under-expanded portions of the liner hanger to deconstruct the segmented swage assembly.

13. The method of claim 11, wherein the segmented cone further comprises an inner diameter (ID) and an outer diameter (OD).

14. The method of claim 13, wherein the segmented cone has an OD of 18.125 inches prior to expanding the liner hanger.

15. The method of claim 13, further comprising:

expanding the segmented cone to fully form to reach a predetermined expansion outer diameter (OD) of 19 inches when an expansion process is complete.

16. The method of claim 11, wherein each detent is configured to engage with the liner hanger to ensure an expansion of the liner hanger is initiated when a predetermined load limit is exceeded.

17. The method of claim 13, wherein each of the second plurality of segments further comprises a high velocity oxy-fuel (HVOF) pad disposed on its surface, the HVOF pad configured to receive a direct overpull when the segmented swage assembly comes into contact with under-expanded portions of the liner hanger.

18. The method of claim 11, wherein:

the first plurality of segments comprises three arc-shaped segments which are coupled to the running tool, and the second plurality of segments comprises three arc-shaped segments which are coupled to the liner hanger.

19. The method of claim 11, wherein each of the first plurality of segments is configured to be in contact with and movable between two corresponding segments of the second plurality of segments.

20. The method of claim 19, wherein each of the first plurality of segments comprises a sliding track engaged with a slider of a respective segment of the second plurality of segments near their respective sides where they are in contact.

* * * * *